United States Patent [19]

Harrison

[11] Patent Number: 4,510,369

[45] Date of Patent: Apr. 9, 1985

[54] ROTARY FURNACE

[75] Inventor: William S. Harrison, Marion, Mass.

[73] Assignee: Engelhard Corporation, Iselin, N.J.

[21] Appl. No.: 523,234

[22] Filed: Aug. 15, 1983

[51] Int. Cl.[3] ..... F27B 7/10

[52] U.S. Cl. ..... 219/389; 219/386; 219/390; 432/103

[58] Field of Search ..... 219/385, 386, 389, 390; 366/144, 146; 432/103, 105, 114, 118; 34/128; 99/348, 427

[56] References Cited

U.S. PATENT DOCUMENTS

| | | | |
|---|---|---|---|
| 1,122,651 | 12/1914 | Shortt | 219/389 |
| 1,363,877 | 12/1920 | Imbery | 219/389 |
| 1,880,822 | 10/1932 | Cook | 219/389 |
| 1,980,920 | 11/1934 | Kelly | 219/389 |
| 2,023,595 | 12/1935 | Kemp | 219/389 |
| 2,041,318 | 5/1936 | Berger | 219/389 |
| 2,094,016 | 9/1937 | Lampel | 219/389 |
| 2,939,383 | 6/1960 | Kanaga | 99/427 |
| 2,939,693 | 6/1960 | Old | 432/118 |
| 3,807,292 | 4/1974 | Cinger | 99/348 |
| 3,918,893 | 11/1975 | Whitaker | 432/103 |
| 4,087,334 | 5/1978 | Harig | 432/103 |
| 4,087,921 | 5/1978 | Blok | 432/103 |
| 4,443,186 | 4/1984 | Shell | 432/103 |

FOREIGN PATENT DOCUMENTS

| | | | |
|---|---|---|---|
| 260732 | 6/1946 | Switzerland | 219/386 |

*Primary Examiner*—Roy N. Envall, Jr.
*Assistant Examiner*—Teresa J. Walberg

[57] ABSTRACT

The rotary furnace has a generally cylindrical rotatable outer member that is driven by a belt and pulley arrangement. An inner member that defines the confines of the heating chamber is freely supported on the outer member to permit free expansion and contraction of the inner member with respect to the outer member. Insulating material disposed between the inner and outer members also joins the inner and outer members together during rotation of the outer member. The insulating material thus transmits the driving force from the outer member to the inner member to thereby cause rotation of the inner member. A cantilevered, non-rotatable heat supply structure extends into the inner member from one end thereof. An access opening to the heating chamber, that is normally sealed during furnace operation, is provided at the opposite end of the inner member. The furnace is pivotally-supported on a frame to permit movement of the furnace to a position wherein the access opening of the furnace is directed downwardly, thereby permitting quick and easy emptying of the furnace contents. The furnace is also loaded through the access opening prior to the heat-treating operation. The frame is supported on wheels for portability of the rotary furnace.

34 Claims, 15 Drawing Figures

ROTARY FURNACE

BACKGROUND OF THE INVENTION

This invention relates to rotary furnaces, and, more particularly, to a rotary furnace that has a lightweight, freely-supported, inner chamber with a cantilevered heater structure that permits end-loading of the furnace and tilting of the furnace body for easy unloading of the furnace contents.

Prior art processing furnaces include the "muffle" furnace type wherein an inner envelope, called the muffle is surrounded by an outer envelope, called a shell. This type of furnace provides a chamber within a chamber to contain the processing atmosphere and minimize heat losses. The thermal efficiency of muffle furnaces, however, is not very good because of heat losses through the outside shell and the necessity of driving the heat through the muffle. In addition, constant cycling, which adversely affects all types of furnaces, restricts muffle furnaces to a useful life as short as twelve months or even less.

Rotary furnaces generally include a rotatable material-holding inner drum, the contents of which are heated by an internal or external heater structure. The inner drum is generally surrounded by one or more outer drums and some form of insulation is provided to maintain a tolerable temperature level at the furnace exterior.

The contents of the furnace, through a tumbling action, are thus continually exposed to the temperature and environment of the furnace for a dynamic heat treatment. While the effectiveness and efficient operation of rotary furnaces are generally recognized, it is also apparent that such furnaces are difficult to unload quickly since the contents are usually spread throughout the furnace chamber. For example, as shown in U.S. Pat. No. 2,125,912, a rotary furnace has one opening on a curved cylindrical wall of the furnace for loading and unloading purposes. The arrangement of such opening on the cylindrical periphery makes it difficult to accomplish a quick unloading of the furnace contents.

Another approach to unloading the contents of a rotary furnace is shown in U.S. Pat. No. 3,802,847 wherein inlet and outlet hoppers are provided on the cylindrical periphery of the furnace at approximate opposite ends of such furnace. The furnace must thus be tilted to be emptied, but such tilting must be slight because the output port is at a right angle to the rotational axis of the furnace. Therefore, this arrangement also does not permit a quick unloading of the furnace contents. In addition, a special heat-resistant drive system is required since one or more drive elements engage the heated periphery of the inner member.

Several other approaches to the general construction of rotary furnaces for a variety of applications are known. These include U.S. Pat. Nos. 1,980,920, 2,041,318, 2,354,100 and 2,809,442. Reference is also made to the furnaces described in Bulletin RT-874 on "Rotating Tube Furnaces" of Harper Electric Furnace Corporation, West Drullard Avenue, Lancaster, N.Y. 14086. These are only of general interest.

Due to the high temperature requirements of many rotary furnaces, it is often necessary to employ relatively thick linings in the furnace chamber which render the furnace structure massive and non-portable. In addition, because the furnace contents usually come in direct contact with the refractory lining, contamination of the furnace contents by flaking of the refractory material is a common occurrence.

Another significant problem with rotary furnaces is that the inner member usually expands and contracts at a rate different from that of the outer member. Therefore, unless the inner member is connected to the outer member, which can lead to stress fractures, complex support arrangements are generally required for the inner member.

It is thus desirable to provide a rotary furnace with a simple effective means for supporting an inner member or an outer member and a rotary furnace which is portable and can be loaded and unloaded in a quick and easy fashion. It is further desirable to provide a furnace that has a high thermal efficiency and has a relatively long, useful life through many thermal cycles.

SUMMARY OF THE INVENTION

The present invention relates to a rotary furnace having inner and outer rotating drum members wherein the inner member is freely supported on the outer member. The furnace has a simple drive means for rotating the inner member of the furnace and is portable. The furnace can be quickly emptied by removing the heat-treated material from the furnace in a direction parallel to the rotational axis of the furnace.

In accordance with one embodiment of the present invention, the rotary furnace includes a generally cylindrical outer drum member having opposite base plate members. An inner drum member having cylindrical end portions is freely supported in slightly larger circular apertures in the ends of the outer drum member's base plate members. The size of the circular apertures in the ends of the outer drum member is sufficient to accommodate expansion and contraction of the inner drum member along its radial axis. The inner drum member can have a ring flange attached at the end of its cylindrical end portion. A non-rotatable heating element can be located within the inner drum member in any suitable manner such as by being supported by a heater element support plate. The support plate can have a sealing means between it and the flange on the inner drum member. The sealing means can take the form of an annular groove in the support plate which has press fit therein, and which projects therefrom, a packing material to seal a clearance between the support plate and the flange. Thereby, longitudinal expansion and contraction of the inner drum member can be accommodated by the sealing means. Thus, there is no fixed connection between the inner drum member and the outer drum member.

The drive means for rotating the furnace includes a simple belt and pulley arrangement for rotating the outer drum member. Insulating material is disposed between the inner and outer drum members so as to function as a means for joining the inner and outer drum members. Consequently, the rotation of the outer drum member is transmitted to the inner drum member through the insulating material.

In one embodiment of the invention, a non-rotatable heat supply structure or heating element extends into the inner drum member from one end thereof and is supported in cantilever arrangement such that the free end of the heat supply structure is spaced from the opposite end of the inner drum member. An access opening, that is normally covered during the furnaces processing operation, is provided at the opposite end of the furnace corresponding to the end of the inner drum member which is spaced from the free end of the heat supply structure. The access opening thus provides access to the inner drum member. It is through this opening that material is loaded into the furnace for heat treatment.

The furnace is pivotally supported on a frame to permit movement of the furnace about an axis perpendicular to the longitudinal axis of rotation. Accordingly, the furnace can be moved from a first position, wherein the access opening is normally oriented in a horizontal position, to a second position, wherein the access opening is displaced approximately 90 degrees from its first position thereby facing in a downward direction. Such movement permits unloading of the furnace through the access opening whereby the heat-treated materials in the furnace can be quickly and easily emptied by flowing outwardly in a direction parallel to the longitudinal axis of the furnace.

The furnace frame is mounted on wheels to render the furnace portable.

DESCRIPTION OF THE DRAWINGS

This invention will now be described by reference to the following drawings and description wherein like elements have the same reference numbers throughout.

DETAILED DESCRIPTION OF THE INVENTION

Figure 1:
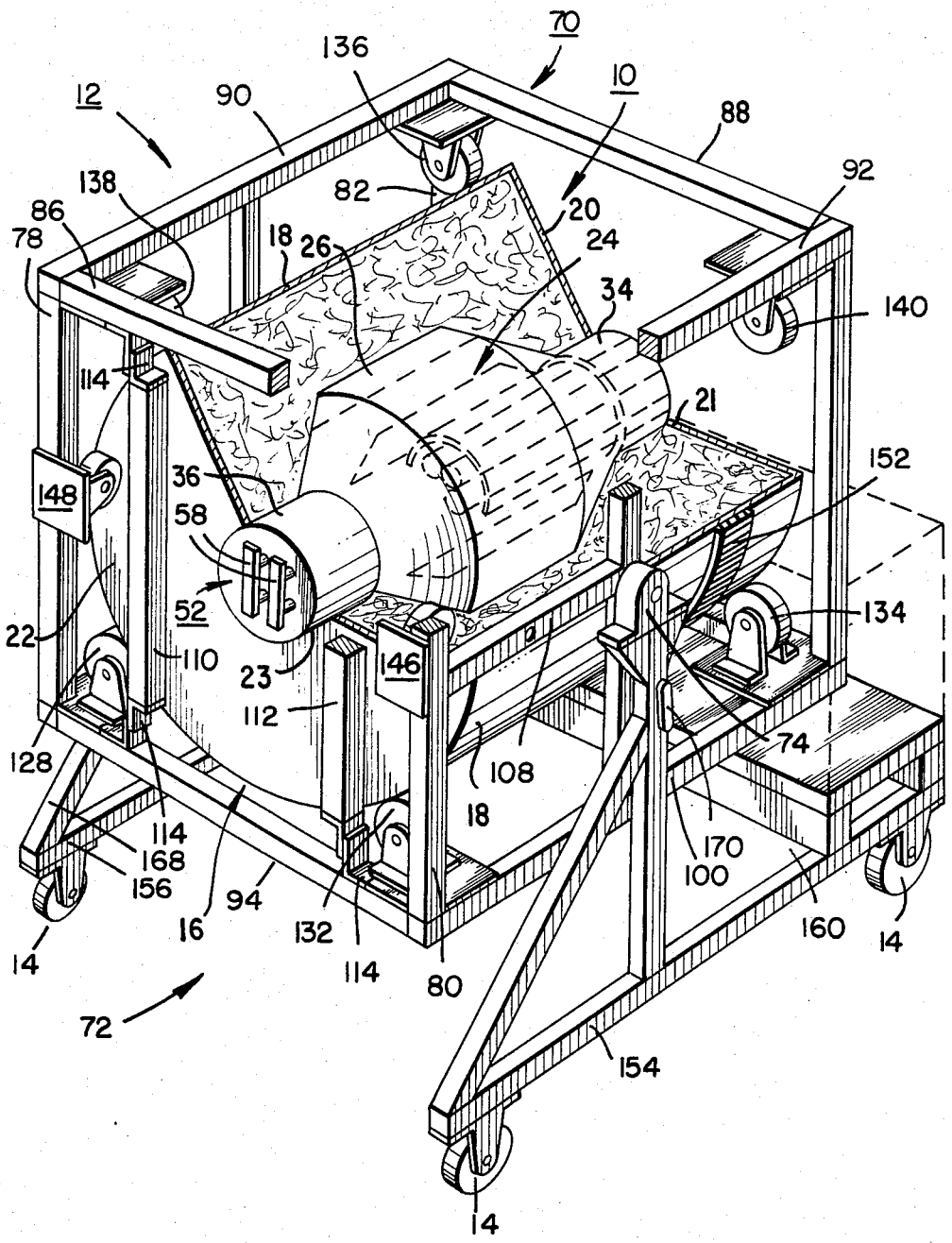
FIG. 1 is a perspective view of a rotary furnace incorporating one embodiment of the present invention.

A rotary furnace is generally indicated by the reference number 10 in FIG. 1. The furnace 10 is supported on a frame 12 having pedestal wheels 14 for mobility of the frame and furnace assembly. The furnace 10 includes a generally cylindrical outer drum member 16 comprising an outer shell 18 and opposite base members 20 and 22 containing respective openings 21 and 23. Although the outer drum member 16 can be made of any suitable material, it is preferably formed of stainless steel.

An inner drum member 24 of the furnace 10 comprises an inner shell 26 spaced from the outer shell 18. The inner shell or member should be substantially resistant to high temperature creep such as, for instance, temperatures ranging up to approximately 1600 degrees F. The shell 26 can be made of any suitable material such as preferably being formed of a high nickel bearing alloy to resist creep phenomena.

The inner shell 26 includes a middle cylindrical section 28, frusto-conical intermediate sections 30 and 32, and cylindrical end sections 34 and 36. Further described portions of the rotary furnace 10 can be any suitably material, but are preferably formed of a high nickel bearing alloy to resist creep phenomena unless otherwise indicated. A plurality of vanes 38 are welded to the inner periphery of the middle cylindrical section 28 and include sloping portions 40 which extend into the frusto-conical intermediate sections 30 and 32. Clips 42 provided in the intermediate sections 30 and 32 hold the sloping portions of the vanes 38.

Figure 2:
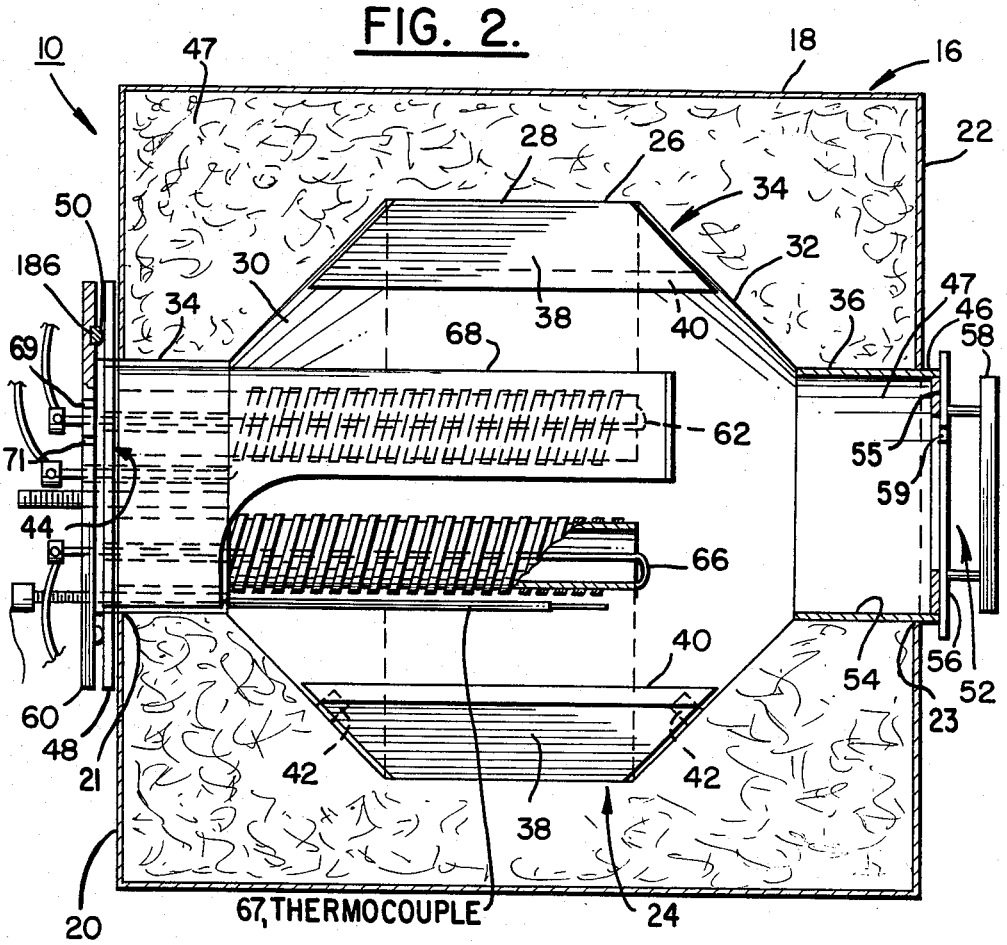
FIG. 2 is a sectional view taken along the line 2—2 of FIG. 1 with the furnace frame removed for purposes of clarity.
Figure 3:
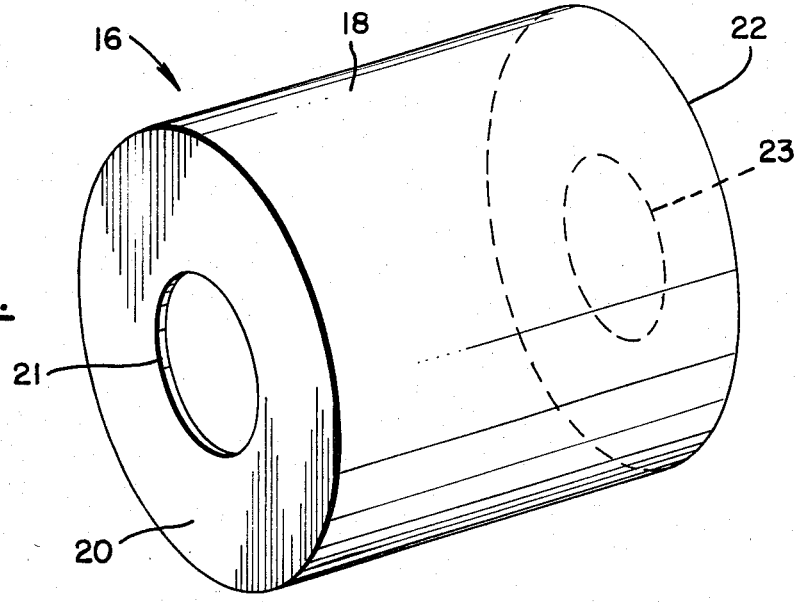
FIG. 3 is a perspective view of the outer shell of the furnace.
Figure 4:
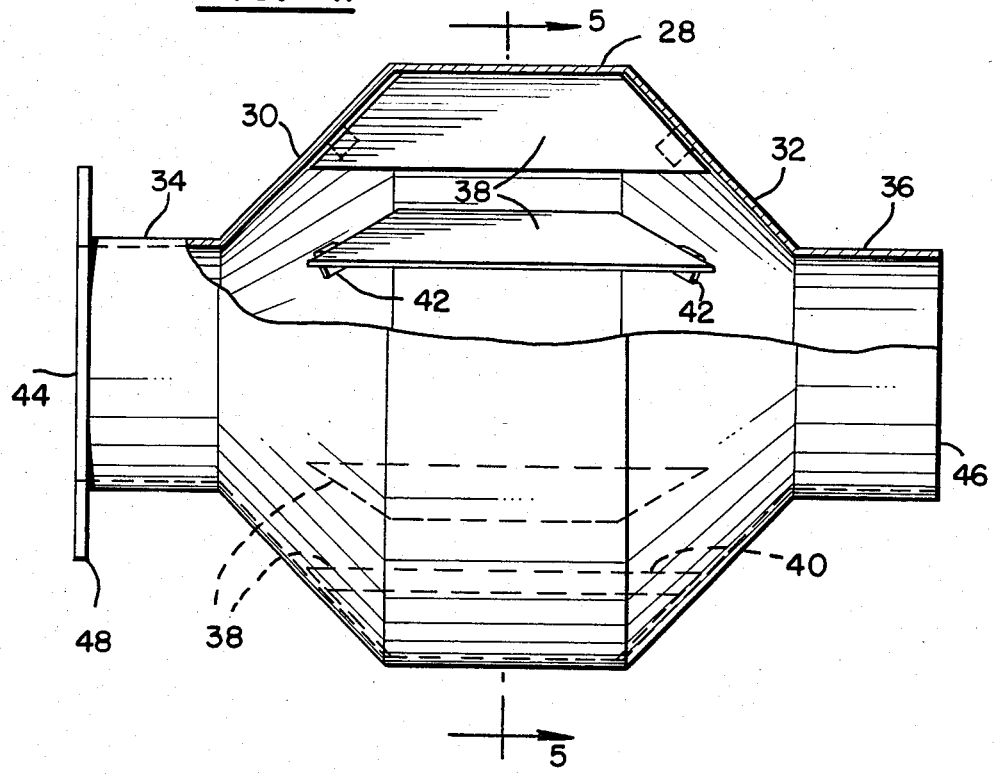
FIG. 4 is a side view partly in section of the inner shell of the furnace.
Figure 5:
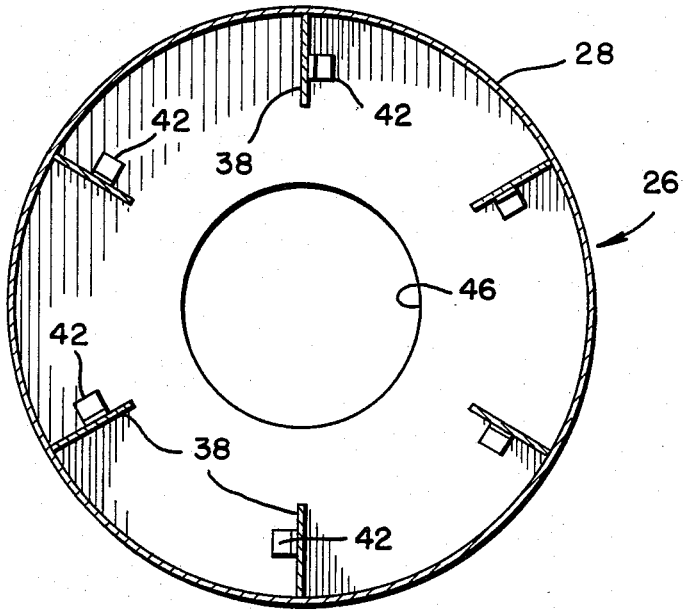
FIG. 5 is a front sectional view taken along line 5—5 of FIG. 4 of the inner shell of the furnace.
Figure 6:
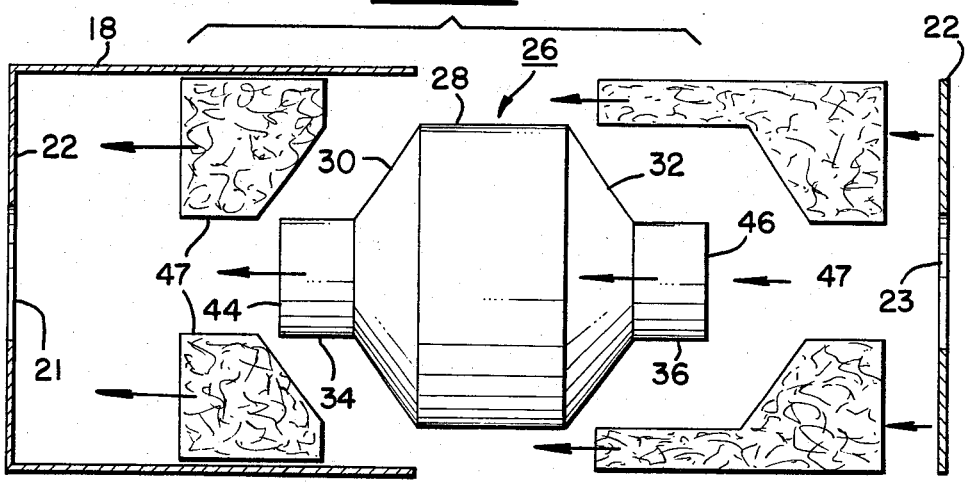
FIG. 6 is a simplified schematic exploded view of the furnace shells prior to assembly thereof.
Figure 8:
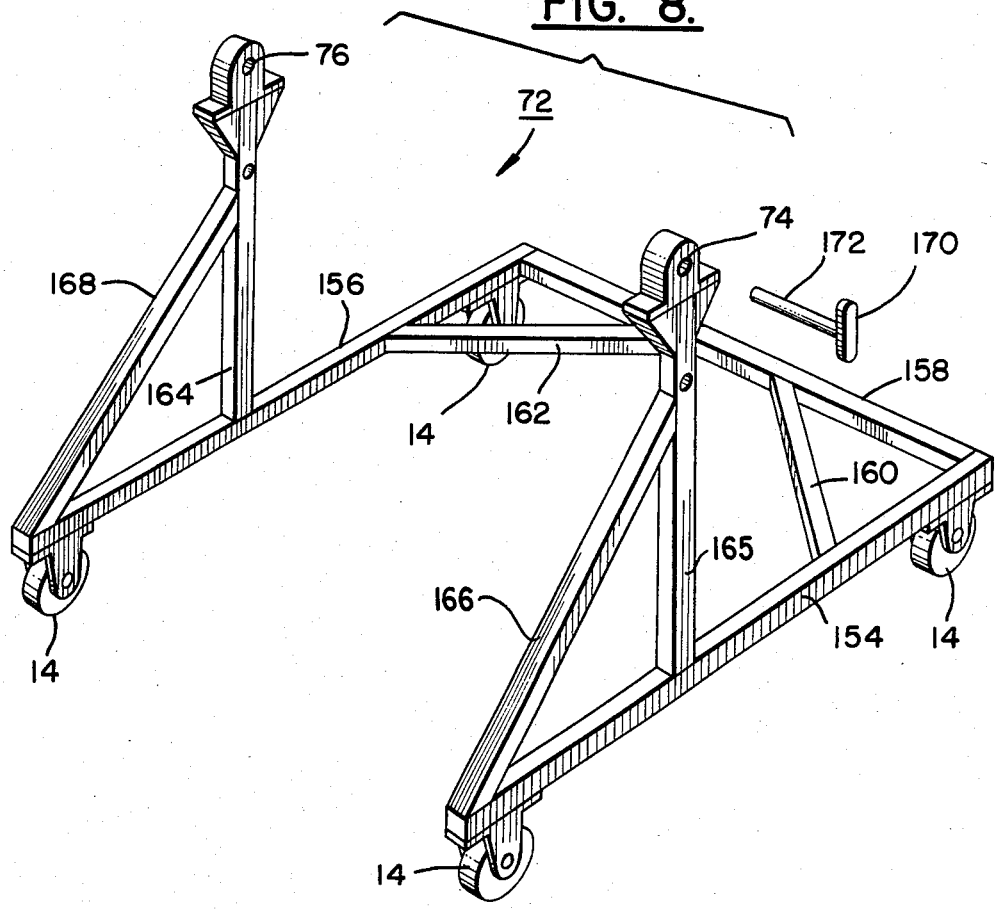
FIG. 8 is a perspective view of the non-pivotal section of the frame.
Figure 7:
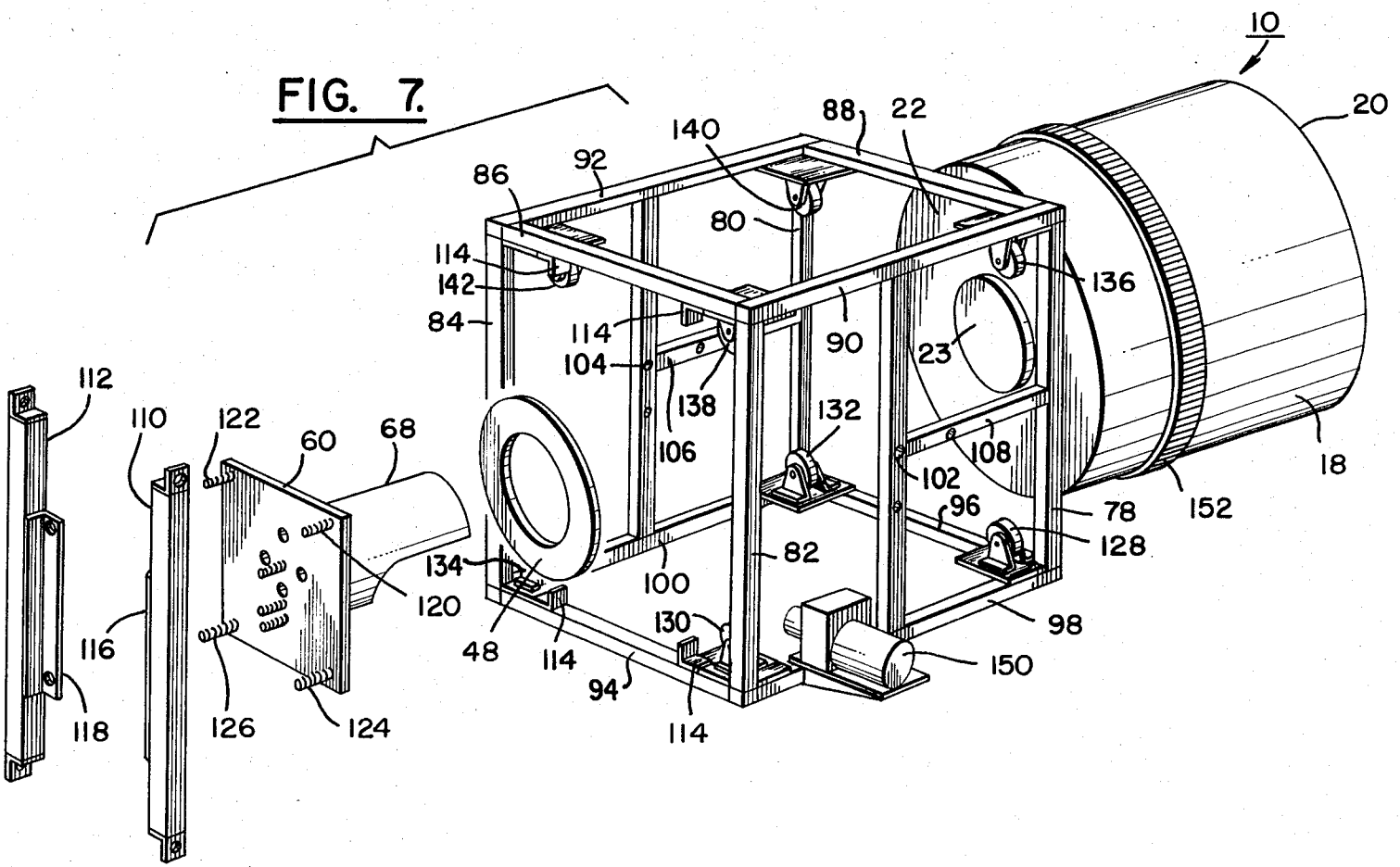
FIG. 7 is an exploded view of the furnace components in addition to the furnace shells prior to assembly thereof the the upper pivotal support frame.

Entry openings 44 and 46 are respectively provided in the cylindrical end sections 34 and 36 of the inner shell 26. The inner drum member 24 is assembled to the outer drum member 16 in the manner indicated in FIG. 2. Accordingly, a suitable insulating material 47 is compressed about 10 to 20 percent, and disposed around the cylindrical end section and the conical intermediate section 30. Any suitable insulating materials can be used such as ceramic fibre of approximately 8 pounds per cubic foot density.

Another section of the insulating material 47 is disposed around the middle cylindrical section 28, the frusto-conical intermediate section 32 and the cylindrical end section 36 to completely envelop the inner shell 26 with the insulating material 47. With the base member 22 of the outer shell 18 detached, the inner shell 26 and the insulating material 47 are disposed in the outer shell 18. A portion of the cylindrical end section 34 thus projects from the opening 21 in the base member 20.

A ring flange 48, which can be formed of stainless steel or other suitable material, is then welded to the projecting portion of the cylindrical end section 34 outside of the base member 20. The base member 22 is then welded to the cylindrical portion of the outer shell 18 to permanently contain the inner shell 26 within the outer shell 18.

With this arrangement, a portion of the cylindrical end section 36 projects from the opening 23 of the base member 22. A suitable annular clearance for thermal expansion is provided between the base member openings 21 and 23, and the cylindrical end sections 34 and 36.

A cover member 52 having a hollow neck 54 packed with insulating material 47 and layered with a high-temperature gasket 55 is inserted into the entry opening 46 of the cylindrical end section 36. The cover member 52 includes a flange portion 56 that supports a gas outlet pipe 57 and handle members 58 that can be formed of wood and attached to the flange 56 in any suitable manner. The cover member 52 is sized to provide a tight slip fit into the entry opening 46.

A heater element support plate 60, supporting three elongated heater elements 62, 64 and 66 projecting therefrom and a guard cover 68, is insertable into the entry opening 44 of the cylindrical end sections 34. The heater element support plate 60 is generally rectangular such that the corners of the support plate project beyond the periphery of the ring flange 48.

Figure 9:
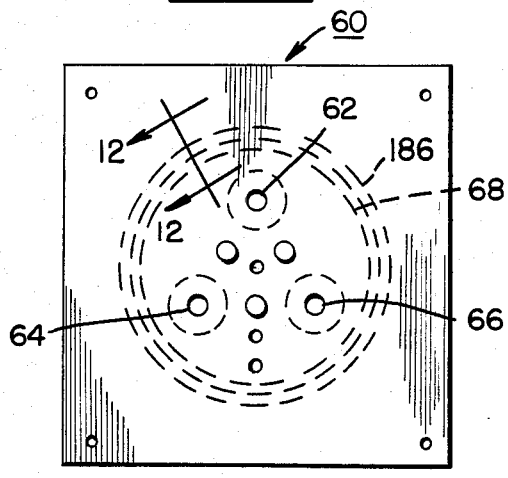
FIG. 9 is a front view of the heater element support plate.
Figure 11:
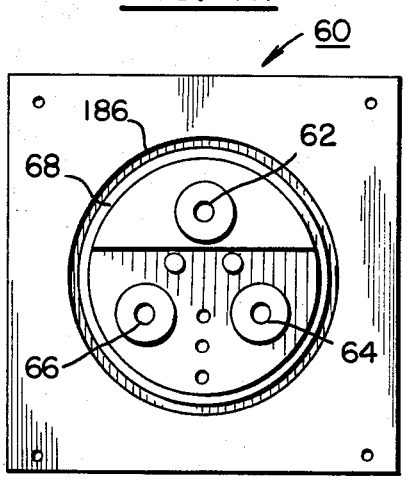
FIG. 11 is an back view of the apparatus in FIG. 9.
Figure 10:
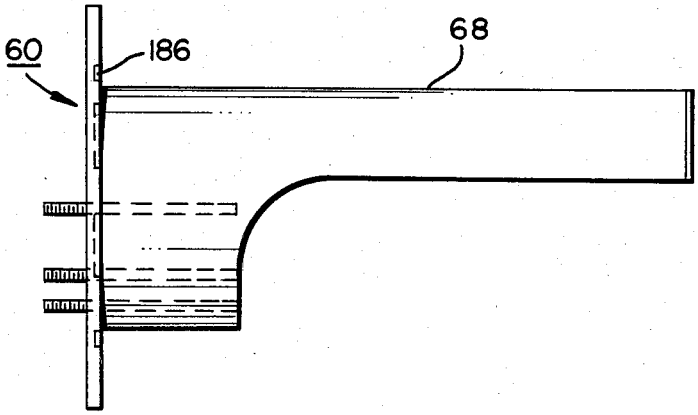
FIG. 10 is a side view of the apparatus in FIG. 9.
Figure 12:
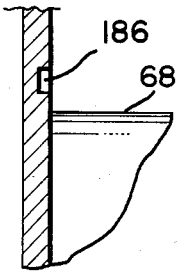
FIG. 12 is a sectional view taken along the line 12—12 of FIG. 9.
Figure 13:
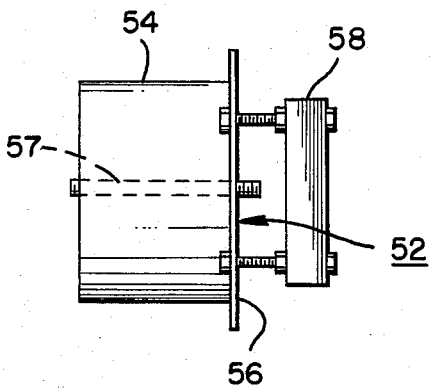
FIG. 13 is a side view of the end cover.
Figure 14:
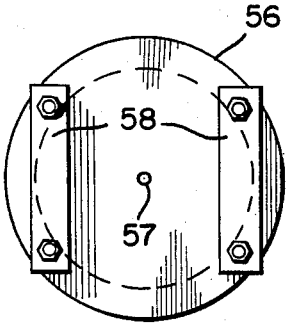
FIG. 14 is a front view of the end cover.

Plate 60 can have an annular groove 186, FIGS. 9, 10 and 11, which is used to retain a suitable sealing material 50 such as a "packing" type seal such as a rope packing. The packing can be press fit in the groove and allowed to project out from the groove towards ring flange 48 to seal a suitable clearance between the ringe flange 48 and plate 60. Any suitable clearance can be used sufficient to enable adequate movement between the plate 60 and flange 48 to accommodate adequate expansion and contraction due to thermal cycling of the furnace. For instance, the packing may project out from the surface of plate 60 by about $\frac{1}{8}$ to 5/32 of an inch. In this manner, expansion can continue in an unrestrained manner toward the unloading end of the drum while expansion is limited to contact of the inner drum ring flange with the rope packing seal fixed in the annular groove of plate 60.

The heater elements 62, 64 and 66 are of any suitable configuration and, for example, can include a ceramic tube surrounded by ribbon elements. For example, the ceramic tube can be an Alundum tube surrounded by Nichrome V ribbon. "Alundum" is a trademark of Norton Corporation and "Nichrome V" is a trademark of Driver-Harris Company. The guard cover 68 is fully cylindrical in the vicinity of the support plate 60 but is in the form of an arc of approximately 150 degrees in the region where the guard cover projects into the frusto-conical section 30 and the middle cylindrical section 28. A thermocouple 67 is provided on the support plate 60 extending alongside the heater elements 62, 64 and 66, and a pair of atmosphere inlets 69 and 71 are likewise provided on the heater element support plate 60 to permit introduction of selected atmospheric gases into the inner shell 26. As will be hereinafter described, the support plate 60 is affixed to the frame 12 so as to be non-rotatable relative to the frame 12 during rotation of the furnace 10.

The frame 12 comprises a pivotal section 70 pivoted to a non-pivotal section 72 at pivot portions 74 and 76. Preferably, the structural members of the frame 12 are formed of hollow steel members. The pivotal section 70 forms an outer box-like skeleton for the rotary furnace 10 and includes four corner upright members 78, 80, 82 and 84. Upper cross members 86, 88, 90 and 92 interconnect the upper portion of the upright members 78, 80, 82 and 84. Lower cross members 94, 96, 98 and 100 connect the lower portions of the upright members 78, 80, 82 and 84. A side upright member 102 is provided between the upper cross member 90 and the lower cross member 98, and another side upright member 104 is provided between the upper cross member 92 and the lower cross member 100. A lateral reinforcing member 106 is provided between the side upright member 102 and the corner upright member 82 and a lateral reinforcing member 108 is provided between the side upright member 104 and the corner upright member 84.

A pair of spaced end support members 110 and 112 interconnect the upper cross member 86 and the lower cross member 94 via angle pieces 114 to facilitate adjustment of the end support members 110 and 112. Angle connecting members 116 and 118 secured to the end support members 110 and 112 interconnect with the heater element support plate 60 via fasteners 120, 122, 124 and 126. The fastener openings in the angle connecting members 116 and 118 are of a size that permits adjustment of the heater element support plate 60 with respect to the angle connecting members 116 and 118 when the fasteners 120, 122, 124 and 126 are secured.

A pair of guide and support wheels 128 and 130 are provided on the lower cross member 98 and another pair of guide and support wheels 132 and 134 are provided on the opposite lower cross member 100. Additional guide and support wheels 136 and 138 are provided on the upper cross member 90, and a still further pair of guide and support wheels 140 and 142 are provided on the opposite upper cross member 92. The support wheels 128, 130, 132, 134, 136, 138, 140 and 142 engage the outer shell 18 of the outer drum member 16 when the rotary furnace 10 is installed in the pivotal section 70 and support the furnace for rotation with respect to the pivotal section 70.

When the outer shell 18 and the inner shell 26 of the rotary furnace 10 are installed on the pivotal section 70, the heater element support plate 60 is affixed to the angle connecting members 116 and 118 to align with the entry opening 44 of the cylindrical end portion 34 to enable the heater elements 62, 64 and 66 and the guard cover 68 to be received within the inner shell 26. A high-temperature gasket 50 is disposed between the heater element support plate 60 and the ring flange 48 to provide a seal therebetween and permit rotation of the ring flange with respect to the fixed support plate 60. A pair of end rollers 146 and 148 provided on the corner upright members 82 and 84 are directed against the base member 22 of the outer shell 18. Lateral movement of the rotary furnace 10 with respect to the pivotal section 70 is thus limited by the end rollers 146 and 148 and the heater element support plate 60.

A drive arrangement for rotating the rotary furnace 10 includes a motor 150 mounted on the lower cross member 98. The motor 150 drives a timing belt 152 which encircles approximately 270 degrees of the outer periphery of the outer shell 18.

The non-pivotal section 72 of the frame 12 includes a pair of lateral side members 154 and 156 joined by a front cross member 158. Corner reinforcing members 160 and 162 are provided between the front cross member 158 and the lateral side members 154 and 156. A pair of side upright members 162 and 164 are provided on the lateral side members 154 and 156 and contain the pivot portions 74 and 76, respectively. Reinforcing members 166 and 168 are provided between the side upright members 162, 164 and the lateral side members 154 and 156, respectively.

A detachable lock-pin provided in the side upright member 162 is engageable with an opening 172 of the side upright member 102 of the pivotal section 70. The lock-pin 170 thus locks the pivotal section 70 into a fixed position with respect to the non-pivotal section 72. A spring-assist member (not shown) is provided between the side upright member 164 of the non-pivotal section 72 and the corner upright member 80 of the pivotal section 70. The spring-assist member is of any suitable known construction and may be of the gas-spring type commonly used in lift-back automobiles. The pedestal wheels 14 are provided at the four corners of the non-pivotal section 72.

Figure 15:
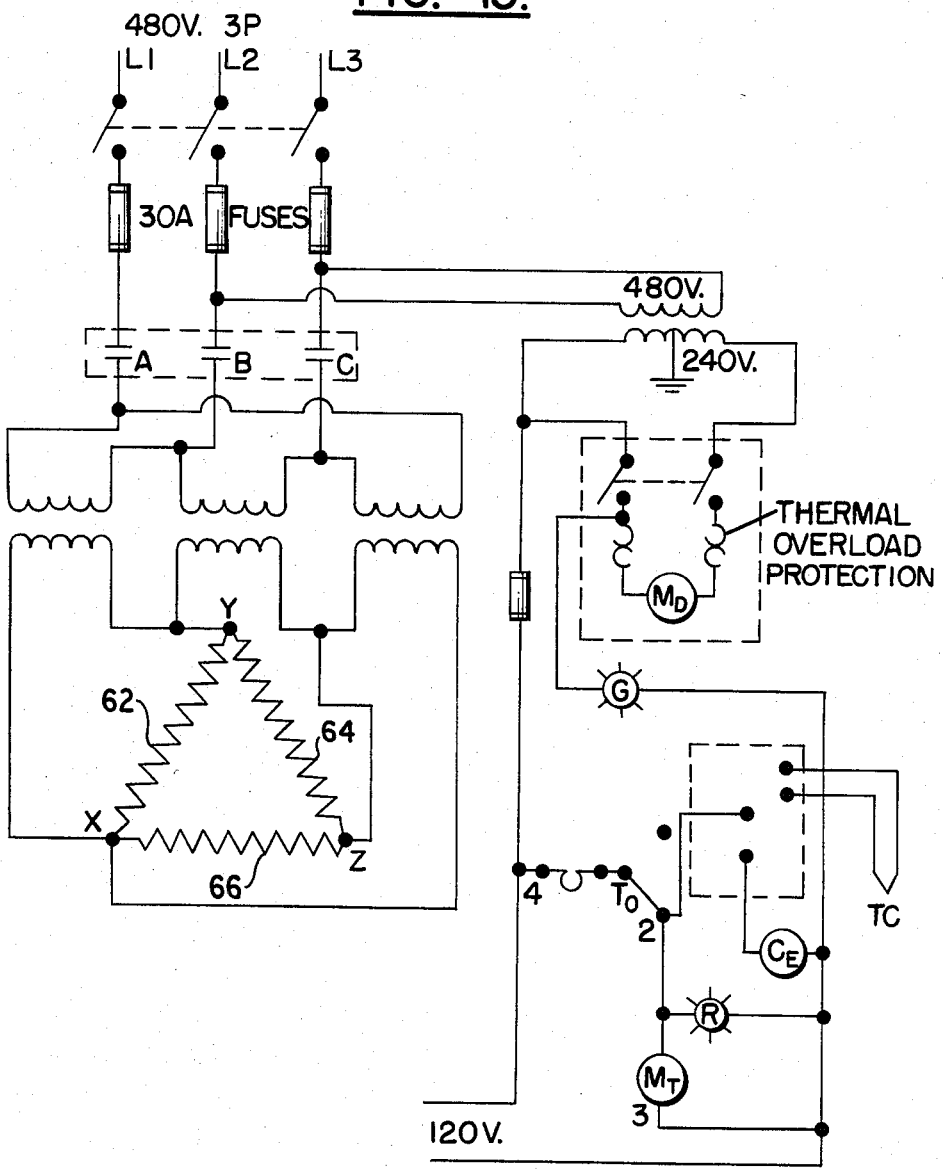
FIG. 15 is a circuit diagram for the rotary furnace.

Any suitable control circuit can be used for the rotary furnace 10 such as the control circuit 182 of FIG. 15. The circuit 182 has the heater elements 62, 64 and 66 connected in delta configuration with the transformers and elements protected by 30-amp fuses. The power source is preferably a 480 volt, 3-phase supply which also operates the drive motor 150 through a step-down transformer. $M_d$ denotes the windings of a drive motor which, along with the thermal overload protection devices, is contained in a dotted square which represents manual motor starter means. G is a green light to indicate the drive motor is on to the operator. $M_T$ denotes the windings of a timer motor and R represents a red light to indicate that the heating cycle is underway. The heating elements may or may not be drawing current when the heating cycle is under way, when the red light is on, depending upon whether or not the temperature controller calls for heat. $C_E$ represents a magnetic coil which closes the electrical controls located in the left corner of FIG. 15.

In using the rotary furnace 10, the cover member 52 is removed from the cylindrical end section 34 and material for loading the furnace is disposed through the entry opening 46 in any suitable fashion such as by a portable chute, funnel or hopper (not shown). Support brackets (not shown) of any suitable known construction for holding the chute, funnel or hopper may be provided to facilitate the loading step. Preferably, the loaded material is fed directly into the frusto-conical section 32 and the middle cylindrical section 28 of the inner shell 26.

Although the particular material processed in the furnace 10 is a matter of choice, such furnace can be used for refining silver cadmium oxide. Accordingly, it is desirable to provide a nitrogen atmosphere in the furnace through the atmosphere inlet 69 when the heating cycle begins. The purpose of a nitrogen environment is to prevent premature oxidation of the silver cadmium oxide before it is brought up to a desired processing temperature.

In using the furnace 10 to process silver cadmium oxide, the overall length of the inner shell 26 can be approximately 36 inches and the diameter of the middle cylindrical portion can be approximately 24 inches. A preferred loading capacity for the furnace can be approximately 1460 troy ounces. However, it will be apparent to persons skilled in the art that the furnace 10 could be designed to accommodate any desired loading capacity or used for any suitable application without departing from the scope of the invention.

After the processing temperature is reached, thw nitrogen inlet 69 is cut off and oxygen is permitted to enter the furnace through the atmosphere inlet 71. The oxygen is placed at a slightly positive pressure over normal atmospheric pressure such as a few inches of water. This pressure is maintained by continuously injecting oxygen into the furnace while allowing a slight bleed-off of the oxygen through the gas outlet pipe 57 in the cover member 52.

In processing silver cadmium oxide in the rotary furnace 10, the heating cycle can be approximately 2 hours with an energy input of approximately 13 kilowatts. Preferably, the drive motor 150 rotates the furnace 10 between approximately ½ and 10 revolutions per minute. Rotation of the furnace 10 in this speed range assures that the material being processed is tumbled in the lower part of the inner shell 26.

The arrangement of the driven timing belt 152 bearing directly on the outer shell 18 of the outer drum member 16 is possible because the skin temperature of the drum 16 is maintained at a relatively low level. This temperature has been found to reach only approximately 140 to 150 degrees F. During rotation of the outer shell 18 by the belt 152, the outer shell movement is transmitted through the insulating material 47 to the inner shell 26, such as by contact due to frictional contact, compression of the insulating material or adhesion of the insulating material to the inner and outer members, thereby causing rotation of the inner shell. If desired, a suitable means such as located on the cylindrical end section 34 can be utilized to engage the heater element support plate 60 and thereby help locate the heater elements 62, 64 and 66 within the end section 34.

The groove 186, the rope packing 50 and the clearance between plate 60 and flange 48 is of a size and depth which accommodate any expansions and contractions of the inner shell 26. The depth and size of groove 186 can be made in any suitable manner to have the seal function as described above. It has been found that the expansion and contraction limits of the inner shell 26 radially and longitudinally with respect to the axis of the inner shell are adequately accommodated by the combination of the annular groove 186 and rope packing material. The inner shell 26 is thus freely supported with respect to the outer shell 18.

During tumbling of the material being processed in the furnace 10 upon rotation of the outer shell 18, the vanes 38 serve to sift and mix the material in the furnace by enabling it to slide downwardly therefrom as the inner shell 26 rotates in a complete circle. The vane height selected is a matter of choice depending upon the material being processed in the furnace 10 and the furnace speed. Preferably, the vanes 38 should permit the material to move in approximately a 180 degree arc in the lowermost portion of the inner shell 26.

During thermocycling, the middle cylindrical section 28 of the inner shell 26 expands an amount that differs from the expansion of the frusto-conical portions 30 and 32. Therefore, the vanes 38 are securely fastened only to the middle cylindrical section 28 and are otherwise free to expand relative to the clips 42 in the frusto-conical sections 30 and 32. The clips 42 also prevent the vanes 38 from bending under the weight of the material being processed since welding of the vanes 38 to the middle cylindrical section 28 may not in some circumstances provide sufficient bending stiffness for the vanes 38.

The guard cover 68 serves to deflect any material being processed from falling onto the heating elements 62, 64 and 66. Since the guard cover 68 has an arc of approximately 150 degrees at the middle cylindrical section 28 and the frusto-conical section 30, the heat from the heater elements 62, 64 and 66 can pass directly onto the materials being processed.

Upon completion of the heating cycle, the rotary furnace 10 is unloaded. To accomplish this, a dolly (not shown) supporting a collection tray (not shown) is located intermediate the lateral side members 154 and 156 of the non-pivotal section 72 of the frame 12. The cover member 52 is removed from the cylindrical end section 36 and the lock-pin 170 is removed from the opening 172. The rotary furnace 10 is then rotated approximately 90 degrees in a clockwise direction to approximately align the opening 44 of the cylindrical section 36 with the collection tray. The processed material within the furnace then falls from the heating chamber defined by the inner shell 26 onto the collection tray. Furnace unloading can thus be accomplished quickly and easily solely under the influence of gravity.

Pivoting of the rotary furnace 10 is facilitated by the spring-assist member and can be accomplished manually by grasping the pivotal section 70 and pivoting it to the location desired. After the unloading step has been completed, the furnace 10 is then pivoted back to its horizontal position and the lock-pin 170 reinstalled into the opening 172. The pivotal section 70 is thus locked to the non-pivotal section 72 of the frame 12. An unlocked furnace of the type described can be constructed at a weight under 500 pounds.

It has been found that the thermal efficiency of a furnace built according to the foregoing construction approaches 50 percent and that such efficiency can be futher improved. Such efficiency is essentially the amount of heat which is actually used for the processing of material as compared with the total amount of heat placed into the furnace. It has also been found that the construction of the present furnace provides a relatively long, useful life as compared to other known furnaces. For example, a furnace life of between 12 and 36 months is easily obtained for a furnace of this construction which is above average for funaces of this type.

It is seen from the foregoing description that the furnace design of the present invention has high thermal efficiency and has extended useful life through many thermal cyclings. In addition, the furnace design of the present invention requires no direct drive connection from the motor to the inner shell, has the inner shell freely supported for expansion and contraction with respect to the outer shell, can be quickly and easily loaded and unloaded and is portable and easily driven by a drive arrangement that need not withstand extremely high temperatures.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A rotary furnace for the heat treating of materials comprising, (a) a drum means for containing materials to be heat treated, (b) said drum means including an outer member having an outer shell and opposite base members, the outer shell having an outer surface, an inner member having an inner shell spaced from the outer shell, means for freely supporting said inner shell with respect to said outer member to permit free expansion and contraction of said inner shell with respect to said outer member, (c) means for rotating said drum means, which includes means for rotating said outer member, and further including, an insulating means disposed between said inner and outer members, said insulating means having a pre-determined joining contact with said inner and outer members such that rotation of said outer member causes rotation of said inner member by virtue of set pre-determined joining contact, and (d) non-rotatable heat supply means extending into said drum means for supplying heat to the contents of said drum means while said drum means is rotating.

2. The rotary furnace as claimed in claim 1 wherein said means for rotating said drum means includes means for rotating said outer member by a driven belt bearing directly on the surface of said outer member of the drum means.

3. The rotary furnace as claimed in claim 1, wherein said joining contact arises from frictional contact between said insulating material and said inner and outer members.

4. The rotary furnace as claimed in claim 2, wherein said joining contact arises from compression of said insulating means between said inner and outer members.

5. The rotary furnace as claimed in claim 1, wherein said joining contact arises from adhesion of said insulating means to said inner and outer members.

6. The rotary furnace as claimed in claim 1, wherein said insulating means is a fibrous material.

7. The rotary furnace as claimed in claim 6, wherein said insulating material is moldable.

8. The rotary furnace as claimed in claim 6, wherein said insulating means is a ceramic fibrous material.

9. The rotary furnace as claimed in claim 8, wherein said insulating means is a material having approximately 8 pounds per cubic foot density.

10. The rotary furnace as claimed in claim 1 wherein said outer member is formed of stainless steel.

11. The rotary furnace as claimed in claim 1 wherein said inner member is formed of a material substantially resistant to high temperature creep at temperatures ranging up to approximately 1600 degrees F.

12. The rotary furnace as claimed in claim 11, wherein said creep resistant material is a high nickel bearing alloy material.

13. The rotary furnace as claimed in claim 1 wherein said heat supply means are supported in cantilever arrangement on one of the base members of said outer member for extension into said inner member.

14. The rotary furnace as claimed in claim 13 wherein the heat supply means has a free end that is free from contact with the other said base member.

15. The rotary furnace as claimed in claim 14 wherein furnace access means are provided in said other base member to permit deposition of material into said furnace and to permit removal of said materials after a heating operation.

16. The rotary furnace as claimed in claim 15 wherein said furnace has a first heating position and is supported on a frame wherein said furnace is pivotally mounted to said frame to permit said furnace to be pivoted with respect to said frame such that said other base member is oriented approximately 90 degrees away from said first heating position to facilitate unloading of said furnace material through the access means in said other base member.

17. The rotary furnace as claimed in claim 15 wherein said furnace frame is supported on wheels to permit portability of said furnace.

18. The rotary furnace as claimed in claim 13 wherein a heat reflector surrounds a predetermined portion of said heat supply means.

19. The rotary furnace as claimed in claim 1 wherein said inner member has a longitudinal axis and includes vanes extending parallel to said longitudinal axis.

20. The rotary furnace as claimed in claim 19 wherein said vanes are radially directed toward said heat supply means.

21. The rotary furnace as claimed in claim 13 wherein said heat supply means includes a core formed of a refractory material and a heater element wound around the core in spiral fashion.

22. The rotary furnace as claimed in claim 21 wherein the refractory material is aluminum oxide and the heater element is formed of a nichrome alloy.

23. The rotary furnace as claimed in claim 21 wherein the heat supply means include three of said cores and three of said heater elements arranged in a delta configuration.

24. The rotary furnace as claimed in claim 1 wherein said inner member has opposite end portions and a flange means at said opposite ends thereof and the means for supporting said inner member comprises a sealing means.

25. The rotary furnace as claimed in claim 24 wherein said sealing means communicates with a plate means having a circular groove with a minimum diameter and said inner member has an inside diameter, the minimum diameter being less than the inside diameter when the furnace is not being heated.

26. The rotary furnace as claimed in claim 25 wherein said circular groove has maximum diameter and said inner member has an outside diameter, the maximum diameter being greater than the outside diameter when said furnace is heated to its operating temperature.

27. The rotary furnace as claimed in claim 25 wherein aid said circular grooves each have a base portion and said inner member has annular end portions wherein the distance between between said base portions is greater than the distance between said annular end portions.

28. The rotary furnace as claimed in claim 24 wherein said inner member contains the materials received in said furnace and includes a first cylindrical portion having a pair of conical sections at the ends of said first cylindrical portion and a pair of reduced cylindrical sections respectively joined to said conical sections and having a reduced diameter with respect to the diameter of said first cylindrical portion.

29. The rotary furnace as claimed in claim 28 wherein said heat supply means are supported in cantilever arrangement on one of the base members of said outer member for extension into said inner member, and wherein the heat supply means has a free end that is free from contact with the other said base member, and wherein furnace access means are provided in said other base member to permit deposition of materials into said inner member.

30. The rotary furnace as claimed in claim 29, wherein said furnace access means comprise an access cover in said other base member covering an opening in said other base member that leads into one of the reduced cylindrical sections of said inner member, said reduced cylindrical sections respectively communicating with said first cylindrical portion via said conical sections.

31. The rotary furnace as claimed in claim 28 wherein said heat supply means extends into said first cylindrical portion through one of said reduced cylindrical sections and one of said conical sections, but does not extend into said other reduced cylindrical section.

32. A drum means for a rotary furnace comprising:

(a) an outer member having an outer shell and opposite base members wherein the base members of said outer shell each have an opening, (b) an inner member having an inner shell spaced from the outer shell wherein portions of said inner member project outwardly of said respective base member openings, (c) means for freely supporting said inner shell with respect to said outer shell to permit free expansion and contraction of said inner shell with respect to said outer shell, and (d) insulating material disposed between said inner and outer shells so as to permit said outer shell to grip said inner shell through the insulating material.

33. The drum means as claimed in claim 32 wherein said inner member includes a middle cylindrical section, end cylindrical sections of lesser diameter than said middle cylindrical section and respective intermediate frusto-conical sections joining said middle cylindrical section to said end cylindrical sections.

34. The drum means as claimed in claim 32 wherein a ring flange is secured to the projecting portion of one of said end cylindrical sections.

* * * * *